US006468037B1

(12) United States Patent
Link

(10) Patent No.: US 6,468,037 B1
(45) Date of Patent: Oct. 22, 2002

(54) FAN CLUTCH WITH CENTRAL VANES TO MOVE AIR TO FAN BLADES

(75) Inventor: Larry R. Link, Frankfort, IL (US)

(73) Assignee: American Cooling Systems, LLC, Grand Rapids, MI (US)

( * ) Notice: Subject to any disclaimer, the term of this patent is extended or adjusted under 35 U.S.C. 154(b) by 0 days.

(21) Appl. No.: 09/632,837

(22) Filed: Aug. 4, 2000

Related U.S. Application Data

(60) Provisional application No. 60/147,700, filed on Aug. 6, 1999.

(51) Int. Cl.[7] ..... F01D 25/12
(52) U.S. Cl. ..... 416/169 A; 416/234
(58) Field of Search ..... 416/169 A, 169 R, 416/175, 234

(56) References Cited

U.S. PATENT DOCUMENTS

| | | | | |
|---|---|---|---|---|
| 1,548,016 A | | 7/1925 | Riboisiere | |
| 3,552,351 A | | 1/1971 | Willem et al. | 118/6 |
| 3,751,181 A | | 8/1973 | Hayashi | 416/132 |
| 3,826,937 A | | 7/1974 | Davies | 310/105 |
| 3,883,633 A | | 5/1975 | Kohler | 310/152 |
| 3,924,585 A | * | 12/1975 | Woods | 123/41.12 |
| 3,932,068 A | | 1/1976 | Zimmerman | 417/420 |
| 4,095,922 A | * | 6/1978 | Farr | 417/313 |
| 4,119,184 A | | 10/1978 | Mower et al. | 192/82 T |
| 4,150,919 A | * | 4/1979 | Matucheski | 416/93 R |
| 4,152,099 A | | 5/1979 | Bingler | 417/420 |
| 4,176,630 A | | 12/1979 | Elmer | 123/41.12 |
| 4,189,654 A | | 2/1980 | Mourier | 310/72 |
| 4,509,091 A | | 4/1985 | Booth | 361/154 |
| 4,554,491 A | | 11/1985 | Plunkett | 318/254 |
| 4,651,922 A | | 3/1987 | Noba | 236/35 |
| 4,671,739 A | | 6/1987 | Read et al. | 416/230 |
| 4,760,898 A | | 8/1988 | Nyquist | 188/161 |
| 4,896,064 A | | 1/1990 | Taiani | 310/104 |
| 5,045,739 A | | 9/1991 | Kuwahara | 310/105 |
| 5,053,666 A | | 10/1991 | Kliman et al. | 310/261 |
| 5,273,143 A | | 12/1993 | Voss et al. | 192/3.58 |

(List continued on next page.)

FOREIGN PATENT DOCUMENTS

| | | |
|---|---|---|
| EP | 0 730 337 | 9/1996 |
| EP | 0 899 858 | 3/1999 |
| GB | 2 278 242 A | 11/1994 |
| WO | WO 93/24986 | 12/1993 |

OTHER PUBLICATIONS

Search Report from European Application No. 98116336.3, a counterpart to the present application dated Nov. 13, 1998.

International Preliminary Examination Report from counterpart PCT Application No. PCT/US98/17751 dated Nov. 5, 1999.

*Primary Examiner*—Edward K. Look
*Assistant Examiner*—Richard A. Edgar
(74) *Attorney, Agent, or Firm*—Fitch, Even, Tabin & Flannery

(57) ABSTRACT

The efficiency of a fan clutch is improved by having a central finned cover attached to the fan clutch at its rotational axis with fins or blades thereon to disperse air radially outwardly from a dead air bubble at the rotational axis of the fan. This is achieved by a cover having a disk-shaped body with fan fins extending from the rotational axis outwardly to the rim of the disk-shaped body to move air from the rotational axis to prevent the build-up of a negative pressure at the rotational axis and this air flow from the rotational axis into the clutch fan blades appreciably increases the total air flow by the fan clutch. The preferred fins are curved between their inner ends at the rotational axis and their outer ends which extend to the fan blades of the fan clutch. The fins may wrap around the rim of the disk-shaped body and the latter may have a curved outer, front surface.

12 Claims, 6 Drawing Sheets

U.S. PATENT DOCUMENTS 5,307,644 A 5/1994 Cummins et al. ..... 62/133
5,387,087 A * 2/1995 Chen ..... 416/188
5,548,173 A 8/1996 Stephenson ..... 310/181
5,565,723 A 10/1996 Dastidar ..... 310/103
5,566,745 A 10/1996 Hill et al. ..... 165/299
5,598,705 A 2/1997 Uzkan ..... 60/599
5,636,719 A * 6/1997 Davis et al. ..... 192/18 A
5,687,823 A 11/1997 Nakagawa et al. .... 192/84.961
5,724,941 A 3/1998 Suzuki et al. ..... 123/339.15
5,763,969 A 6/1998 Metheny et al. ..... 310/62
5,900,203 A 5/1999 Needham et al. ..... 264/248
6,010,305 A * 1/2000 Hauser ..... 416/169 A
6,302,066 B1 * 10/2001 Steinmann ..... 416/175 X
6,382,915 B1 * 5/2002 Aschermann et al. ... 416/169 A

* cited by examiner

FAN CLUTCH WITH CENTRAL VANES TO MOVE AIR TO FAN BLADES

This application claims the benefit of provisional application No. 60/147,700 filed Aug. 6, 1999.

FIELD OF THE INVENTION

This invention relates to a fan clutch and to its construction, and more particularly, to the use of such a clutch in vehicles or the like.

BACKGROUND OF THE INVENTION

The present invention relates to an improvement of fan clutches and, in particular, to the improvement of efficiency of such fan clutches. Commonly used fan clutches in large trucks in the United States are constructed with a first clutch component being driven by a motor-driven pulley and having a frictional face, which is clutched to or separated from a second frictional clutch face on a driven clutch portion carrying fan blades. When the clutch faces are engaged they transmit full power without a slippage between the frictional faces. The clutch faces are typically engaged by a pneumatic or electromagnetic actuator with the pneumatic actuator requiring the use of air on the vehicle. U.S. patent application Ser. No. 60/095,498, filed Aug. 6, 1998 discloses a magnetic fan clutch where a magnetic field is used to join the driving portion to the fan blade driven portion.

The fan clutch used for large trucks or the like take considerable horsepower to accelerate and to overcome the inertia thereof and to provide the desired air flow to cool the radiator liquid being used or to cool a motor. For example, when the truck fan is of a 32" diameter, the horsepower used to drive the fan can be as much as 40 to 80 hp for large trucks which have engines in the range of 200 to 600 hp. Typically, such large fans cause an air flow of about 2,000 cfm. If the amount of air flow can be increased so that a smaller diameter can be used, the resulting reduction in horsepower needed to cool the engine can result in increased fuel economy for the truck. The power used to drive a larger fan versus a smaller fan is not a linear increase but a much higher increase. Thus, any increase in fan throughput without an increase in fan diameter can be significant. Also, smaller fans can reduce the large amount of fan noise coming from a vehicle.

In Europe and in other places such as South America there is often used a viscous fluid fan clutch which is always rotating at speeds of 400 to 600 RPM, even when the fan is turned off. That is, the viscous fluid rotates the fan because of the friction and shears. When the viscous fan clutch is turned on, it never is able to produce or transfer 100% of the input power or torque because 7–10% of the power is lost with viscous fluid shearing. Because of the fluid viscosity and friction, this fan clutch is never totally disengaged to be free-wheeling as it is constantly engaged so that it is always using a considerable amount of the power. This power, of course, is wasted fuel consumption, which makes it a relatively inefficient fan clutch from a fuel economy standpoint. This particular fan clutch also uses a bi-metallic thermostat on the front of the fan assembly to measure temperature and a plunger is operated by the thermostatic switch, which requires ram air to operate. On slow moving construction vehicles or the like where there is relatively little ram air, such a thermo-statically controlled fan clutch is not readily usable. Likewise, for an ON/OFF fan clutch used on trucks there is a requirement for the use of compressed air which is often not available for construction or farm equipment and therefore makes the clutch less saleable to makers of such equipment.

Currently, it is desired to eliminate the 7–10% viscous shear inefficiency without an increase size of the radiators and to provide this increased efficiency to power the fan in order to run the engines hotter using the same cooling equipment. Thus, there is a need for increasing air efficiency to help cool these hotter engines.

With respect to each of these various kinds of fan clutches described above, there is a need for a new and improved fan clutch that has increased air moving efficiency.

SUMMARY OF THE INVENTION

In accordance with the present invention, a rotatable fan clutch having rotatable blades driven by a motor is provided with blades, vanes or fins to disperse air outwardly from a dead center of the fan at a central axis area to the location of the fan blades to increase the efficiency of the fan clutch. This is achieved by providing small interiorly-located vanes or fins that pump the air out of this central area to prevent a buildup of a bubble of air or negative pressure at the central area; and thereby provides an appreciable increase in the flow of air from the fan clutch.

In a preferred embodiment of the invention, the fan clutch-driven portion carrying the fan blades is provided with a central hub or cover with integral, curved fins or blades projecting from the central cover and shaped and sized to force air at the central area of the fan outwardly toward the fan blades, which continue to force the air to flow from the fan. That is, the air flowing toward the central axis of the fan is swept outwardly in a continuous flow by rotating curved fins or blades to join the continuous air flow being generated by the fan blades. In the preferred embodiment of the invention, the vanes are integrally molded with a cover and are curved between their inner and outer ends. By way of example, in the illustrated embodiment, the fan output was increased from about 2,100 cfm to 2,500 cfm with the addition of these rotating vanes causing air flow from the central area of the rotating fan clutch.

Inexpensive plastic vanes may be integrally molded on a separate plastic cover or cone which is fastened to the driven fan portion of the clutch. In the embodiment illustrated herein, the fan clutch is a magnetic fan clutch with a molded, plastic, driven clutch portion and a separate, discrete, molded plastic cover element, which has the vanes and which is fastened to the molded, plastic, driven portion of the magnetic clutch.

BRIEF DESCRIPTION OF THE DRAWINGS

As shown in the drawings for purpose of illustration.

DESCRIPTION OF THE PREFERRED EMBODIMENTS

Figure 1:
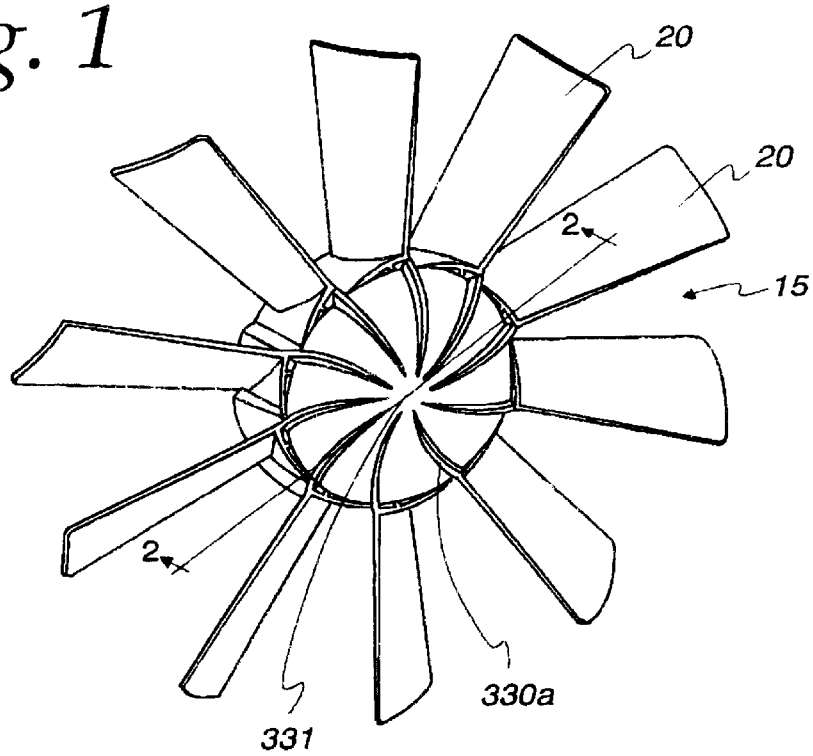
FIG. 1 is a perspective view of the fan blades and a central hub having air-moving vanes thereon on a fan clutch constructed in accordance with a preferred embodiment of the invention.

As shown in the drawings for purposes of illustration, the invention is embodied in a magnetic fan clutch system 15 such as may be used with an internal combustion engine used with vehicles such as a truck or heavy equipment vehicles such as a bulldozer, backhoe, farm tractor, etc. or with stationary power plants having an internal combustion chamber such as a diesel engine or other type of engine which drives a large fan for cooling. In the heavy equipment area, the current fans are connected directly to the water pump and are driven continuously and are not provided with a fan clutch. The fan clutches currently used on trucks in the United States require compressed air to engage clutch frictional faces; but there is no compressed air available on heavy duty, slow moving equipment to operate such a fan clutch. In Europe and South America, a viscous fluid fan clutch is used and is operated by a thermostatic device having a bi-metallic, operated plunger which relies on heavy ram air flowing across the bi-metallic, thermostatic device for proper operation of the clutch. In slow moving, heavy duty equipment there is no such ram air pressure to allow the use of such a thermostatic switch device.

In accordance with the preferred invention, there is provided a magnetic fan clutch 15 which is formed with a magnetic field coupling a driving or pulley element 16 which is molded of lightweight, strong plastic to a driven or fan cover 18 which is made of lightweight, strong plastic in contrast to the heavy steel pieces used in the conventional ON/OFF clutches having engageable friction faces. In accordance with the embodiment of the invention illustrated herein, there is a relatively slow, gradual torque transfer (i.e., a "soft engagement") of these plastic clutch elements which means that the clutch goes from OFF or no torque to full torque over a relatively long period of time, such as 6 seconds versus the sharp impact torque transfer pulse of the ON/OFF frictional faces of a clutch which typically transfer from zero to full torque over a period of about 1.2 seconds. This faster pulse transfer of torque of the common ON/OFF system necessitates the use of metal parts to withstand the loads and also applies high torque loads to the bearings and to the fan belt which decreases substantially their respective lives. Because of the more gradual torque transfer of the magnetic clutch, it is able to be made with lightweight, plastic materials rather than the heavy steel materials.

As stated above, any increase in fan throughput without an increase in fan diameter is most desireable for fan clutches which use considerable power and lower fuel economy. Also, there is a space or volume limitation in vehicles, such as trucks, for the fan and fan blade diameter. It has been found that fan clutches can have a dead space or negative pressure at the central axis of the fan clutch, particularly as the vehicle is traveling. It has been found that there is a bubble of air at the center of the fan clutch, particularly on fan clutches mounted in trucks.

For the purpose of dispersing air from a dead central area in front of the central rotational axis of the fan, and to thereby increase air flow throughput by the fan blades 20, there are provided small additional blades, vanes or fins 330 (FIGS. 1–6) secured to a rotating part of fan clutch and located adjacent the rotational axis 224 of the fan. These vanes or fins are rotated with rotation of the driven portion of the fan clutch and pump air from this central area about the axis 224 outwardly to the fan blades 20, which continue to pump this air as well as the other air coming directly at the fan blades. The removal of the air at this central area has been found to provide an appreciable increase in the flow of air from the fan. These interiorly located vanes or fins prevent a build-up of an air bubble or negative pressure at the front center portion of the fan. The present invention may be used on all fan clutches, but has been tested and found most useful on the magnetic fan clutches described herein.

Figure 2:
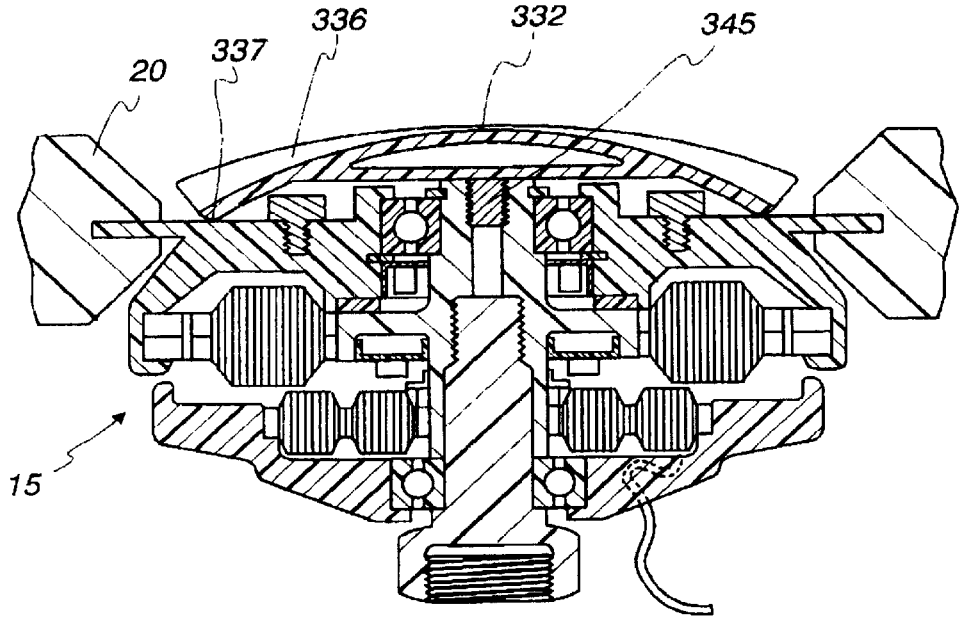
FIG. 2 is a sectional view of the fan clutch hub of FIG. 1 taken along line 2—2 of FIG. 1.
Figure 3:
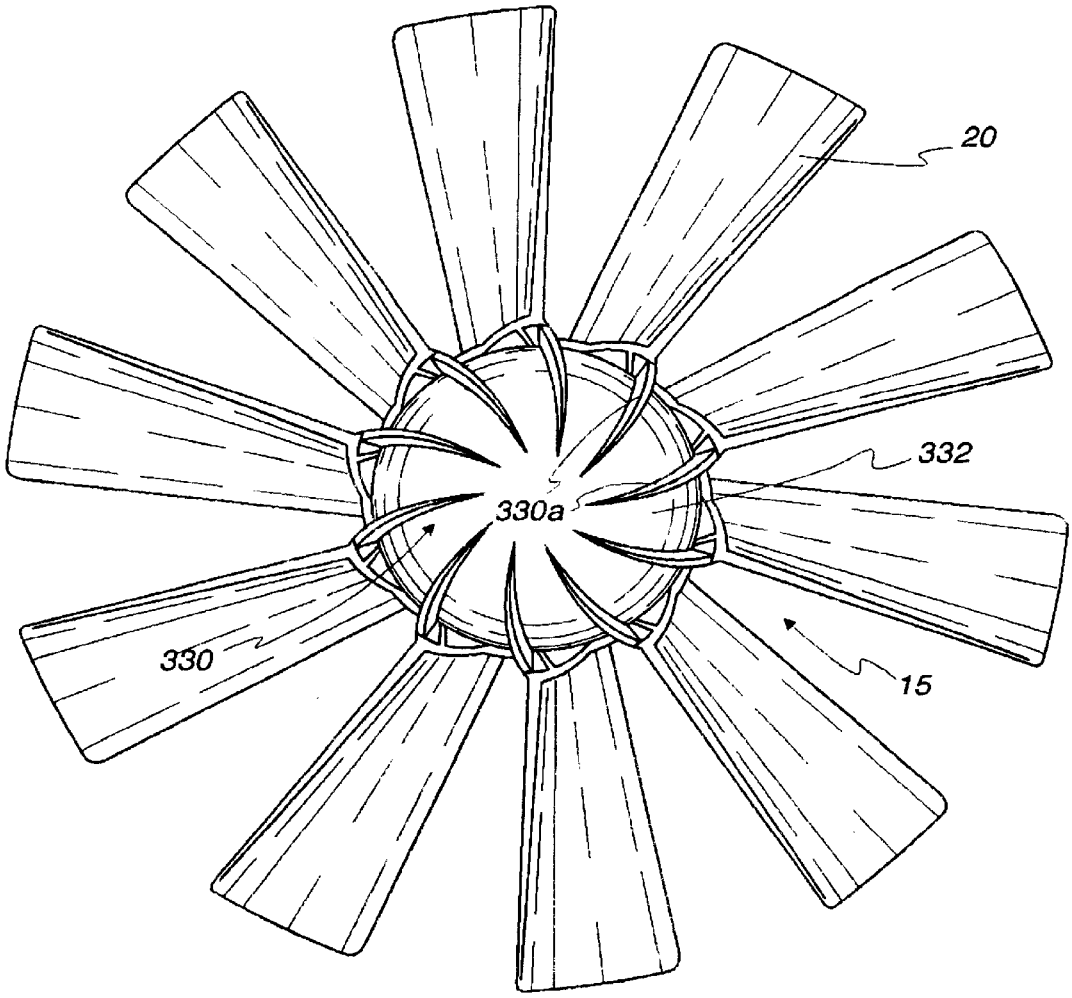
FIG. 3 is an enlarged view of the fan clutch of FIG. 1.
Figure 4:
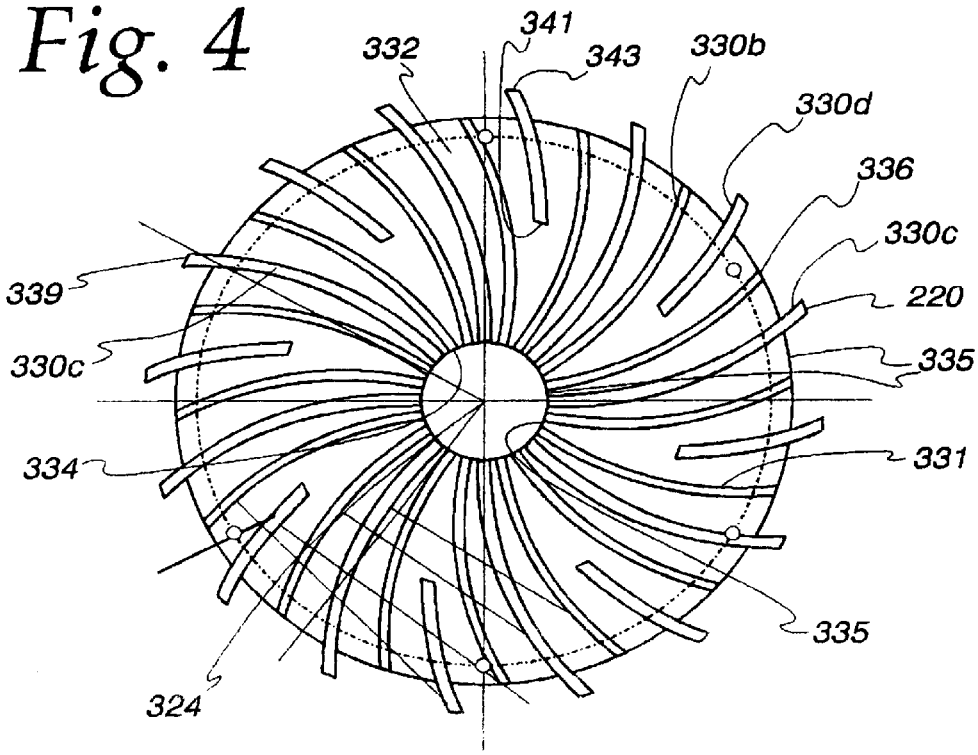
FIG. 4 is a view of another embodiment of a fan clutch hub with blades thereon.
Figure 5:
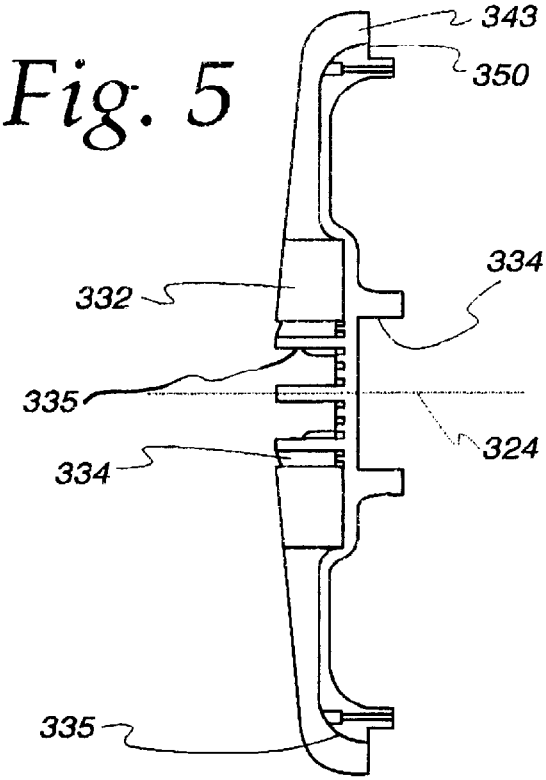
FIG. 5 is a cross-sectional view of the fan clutch hub of FIG. 4.

In the embodiment of FIGS. 1–3, the fins 330*a* are all of the same size and shape and are integral with a central cover or hub 331 made of one piece of plastic. On the other hand, as shown in FIGS. 4 and 5, the fins 330*b*, 330*c* and 330*d* may be made of different configurations such as being longer, being thicker in cross-section, and having different inner and outer end locations. The fan hub 331*a*, which is shown in FIGS. 4 and 5, comprises a central body 332 of circular shape having an inner, central opening 334 which will be centered on the rotational axis 224 of the fan clutch. A first set of integral fins 330*b* extend outwardly from inner ends 335 at the central opening 334 and have a curved configuration to outer ends 336 at an outer rim 337 of the central body 332. Other thicker fins 330*c* comprise a second set of integrally molded fins on the central body 332 and extend in a curved manner from inner ends 335 at the opening 334 to and beyond the outer, circular rim 337 of the central hub to outer ends 339. A third set of integral short fins 330d are provided on the hub and begin at inner ends 341 located midway of the central body and project to outer ends 343, which are located beyond the rim 337 of the hub body 332.

Typically, a bolt 345 (FIG. 2) is threaded into the driven member carrying the fan blades 20 and bolts the finned hub 332 to the driven member to rotate therewith. The hub body with fins acts as a cover over the central portion of the fan clutch. In the embodiment of FIGS. 22 and 23, a separate bolt (not shown) may be used at the opening 334 to bolt the fan body to the rotating fan portion. If desired, the fan blades 20 and hub body 332 with the fins 330 may be integrally molded together.

In the embodiment of FIGS. 1 and 2, the fan fins 330a project outwardly further from the body 332 in the radially, outward direction; and the body 332 is curved from the center toward the outer rim 337. In the embodiment of FIGS. 4 and 5, the hub body 332 (shown in dark cross-section) has the fins 330 projecting further outwardly therefrom at the center than at the ends located at the rim 337. The outer ends 343 and 339 of the fins 330c and 330d may wrap about the curved rim 337 of the hub body 332, as shown in FIGS. 4 and 5. Manifestly, the hubs and the fins may be varied from that illustrated herein and given by way of examples.

Figure 6:
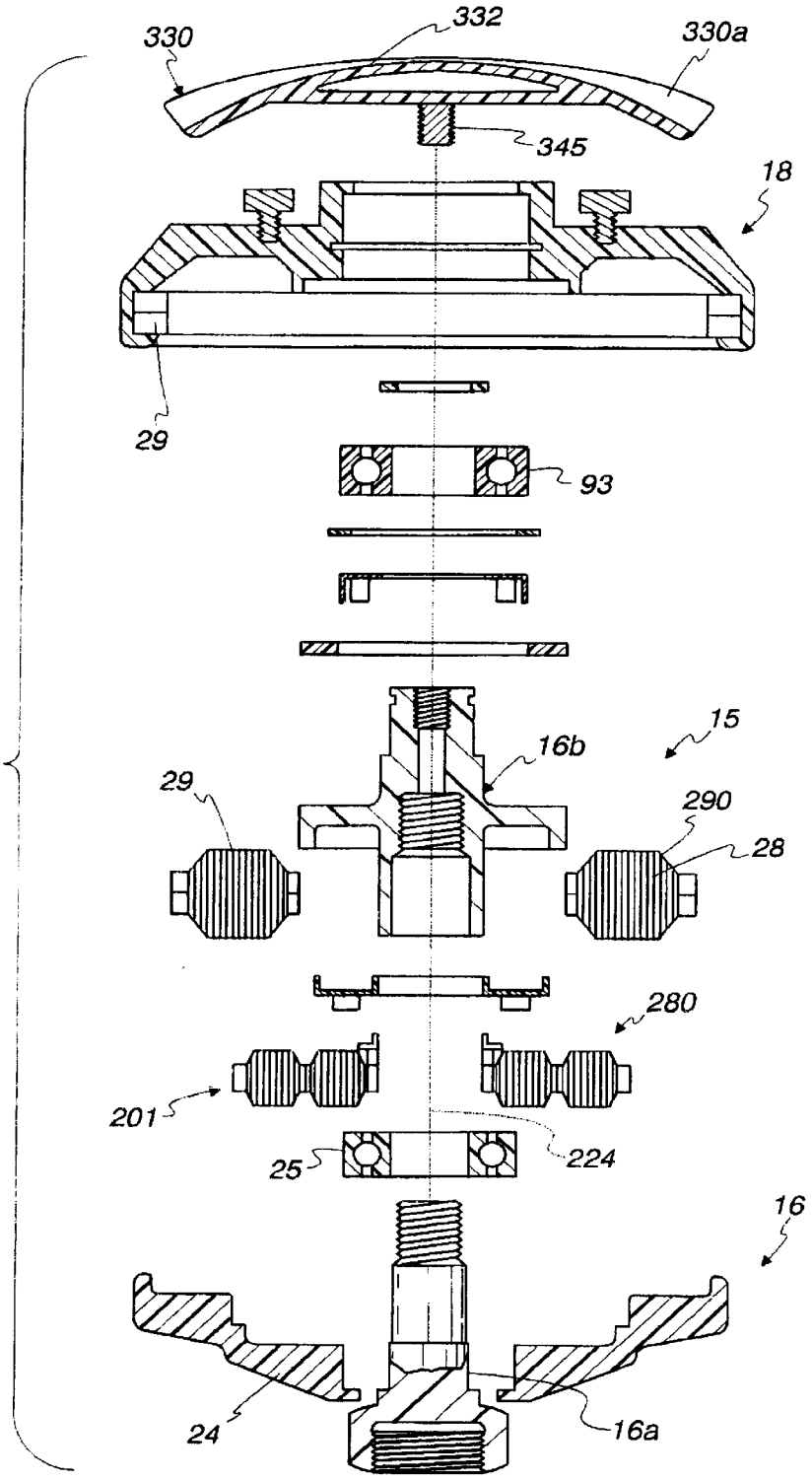
FIG. 6 is an exploded view of a fan clutch and generator having the central hub of FIGS. 1–3 to be bolted by a bolt to the driven, rotatable member.
Figure 7:
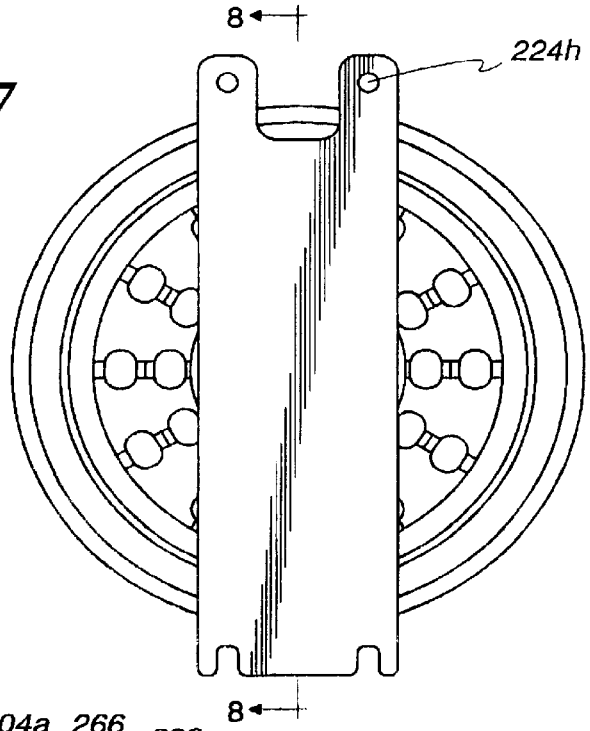
FIG. 7 is a front elevational view of a mounting plate and a magnetic fan clutch having a generator and constructed in accordance with a second embodiment of the invention.

The magnetic fan clutches disclosed herein are constructed in accordance with the disclosure of U.S. patent application Ser. No. 60/095,498, filed Aug. 6, 1998, which is hereby incorporated by reference, as if fully reproduced herein. The magnetic fan clutch illustrated in FIGS. 2 and 6 comprises a rotatable driving element, such as a drive pulley 16, which may be driven by a drive belt (not shown) driven by the engine of a vehicle or the like. The driving element 16 carries electromagnetics 28 which cooperate with magnetic elements 29 carried by the driven element 18, and on which are mounted the fan blades to be rotated about a central axis through the magnetic fan clutch. A stationary mounting support 24 is secured to the vehicle engine or other stationary support. The mounting support 24 carries a ball bearing 25, which rotatably supports the driving element 16 for rotation about an axis 224 (FIG. 6). The driving element comprises a rotatable shaft member 16*a* and a pulley extension 16*b* threaded thereon. Electromagnetics 28 on the rotatable driving element extension 16*b* are positioned closely adjacent magnetic elements 29 carried by the driven element to transfer torque across the air gap therebetween. The driven element 18 is mounted by a roller bearing 93 mounted on the pulley extension 16*b*. The rotation of the driven element and its fan blades 20 is accomplished by torque transferred across the air gap. Usually, the torque transferred ranges from about zero, when the fan clutch is in the OFF position, through a range from about 0% torque transfer to about 100% torque transfer when the driven element is locked by the magnetic field to rotate at the same speed as the driving element.

Figure 8:
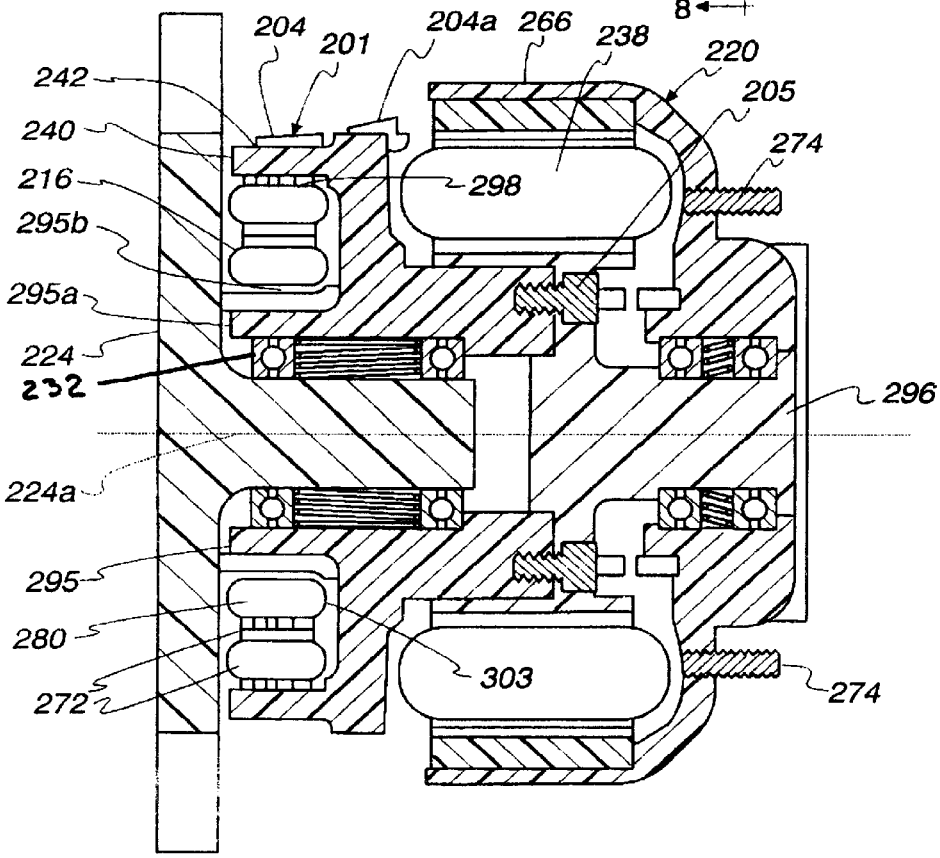
FIG. 8 is a cross-sectional view showing the fan clutch and generator with the mounting plate of FIG. 7.
Figure 9:
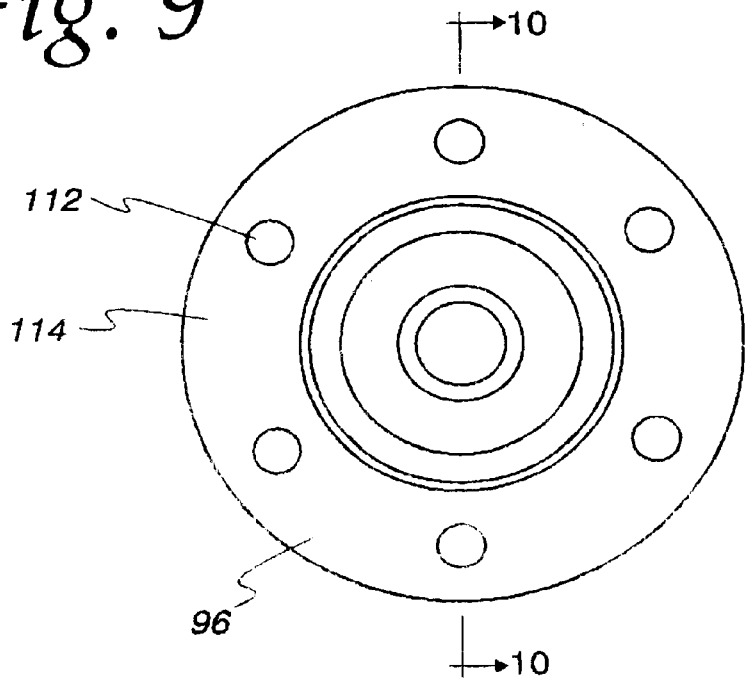
FIG. 9 is a front elevational view of a pulley extension used with the electromagnetic clutch of FIG. 8.
Figure 10:
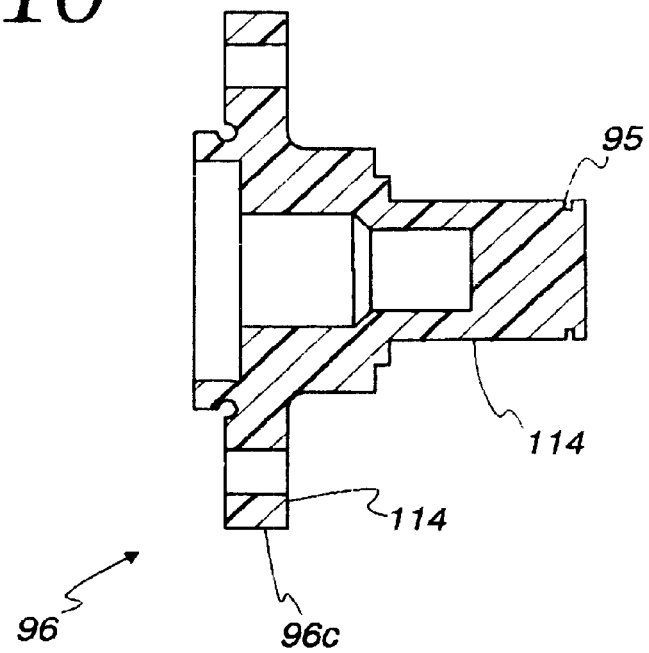
FIG. 10 is a cross-sectional view of the pulley extension taken along the line 10—10 in FIG. 9.

Turning now to the magnetic fan clutch, illustrated in FIGS. 7–10, the fan clutch preferably includes a generator 201 which serves to generate electrical power to be used to operate the electromagnets 228 which are opposite the magnetic elements 229 to generate a magnetic field across an air gap 225 between the electromagnetic pole pieces 229 and the magnetic elements. Some manufacturers of vehicles do not wish to allow the taking of power such as, for example, 10 amps and 12 volts, from their existing power supplies to power the electromagnetic clutch and therefore the electrical generator 201 has been added to supply the power. The electrical generator 201 is driven by the motor through belts 204 and 204*a* (FIG. 8) which are meshed within the grooved surfaces 242 on a rim portion 240 of the driving pulley 216. The molded, plastic pulley 216 has affixed thereto a molded, plastic pulley extension 296. The molded, plastic mounting plate 224 has a flat plate portion which is to be mounted to the engine by fasteners through openings 224*h*. The mounting plate 224 has a central hub or post 224*a* carrying the bearing 232*a* which rotatably mounts the pulley driving member 216 which is being driven by the belts 204 and 204*a*. The electromagnet carrying pulley incurs a pulley-extension portion 296 fastened by fasteners 205 to the driven pulley portion 216. The pulley extension carries the series of flat post plates made of 1008/1010 steel. In a similar series of plates of ferromagnetic material such as 1008/1010 steel are used to form the posts for the inner and outer coils 280 and 290 which are separated by an air gap 292, as shown in FIG. 8.

The electrical generator inner electromagnets 280 are supported by a stationary metal bracket 295 which has a vertical portion 295*a* fastened to the mounting plate 224 and has a horizontal portion 295*b* which supports the inner rings and the coiled wires 298 about the flat metal rings to form the inner pole pieces 280. The outer electromagnetic coils 290 are secured to the inner side of the rotating sleeve 216 and include metal rings or plates 301 which are wound about by wires 303 to form the inner pole pieces 280. A trickle current, for example, 3 amps is applied to the inner pole pieces 298 and the mechanical energy from the engine is applied through the belts 204 and 204*a* to rotate the sleeve and the outer pole pieces 290 to cause the generation of electrical power which is AC power. A suitable rectifying device is carried on the rotating sleeve to rectify the AC current to DC current which DC current is then fed over conductors to the fan clutch coils 224 of the electromagnetic elements 228. Herein, the illustrated generator uses twenty laminated plates of 1008/1010 steel about 0.030 thick and about twenty-four turns of wire to supply about 50 volts and 8 amps for a magnetic fan clutch used on a large truck with a 32 inch fan. Thus, the rectified AC power being generated by the generator is applied to the fan clutch by the magnetic coil elements. The electrical generator can be constructed to generate 160 volts and 13 amps which is more than is needed to operate the clutch and this additional power can be sent to power other portions of the vehicle, such as lights. This is only an example of the electrical generator and clutch combination and the design and power can be changed substantially from that given herein.

The magnetic fan clutch of FIGS. 7–10 may have the hub body 331 with the air dispersing blades or fins 330 thereon attached to its driven cover 220 to be rotated therewith to pump air outwardly from the central area about the rotational axis outwardly to the fan blades.

What is claimed is:

1. A fan clutch for selectively coupling a source of power:

a fan clutch having a rotatable driving member connected to the source of power to be rotated;

a rotatable, driven member for selective coupling to the driving member to be rotated by the driving member when clutched thereto;

fan blades and having inner ends projecting from on the rotatable, driven member to cause air flow to provide cooling and rotatable about a rotational axis;

a central cover secured to cover a central portion of the driven member at the rotational axis and driven by the rotatable driven member and located at the rotational axis of the fan clutch;

fasteners securing the central cover to the driven member to rotate therewith;

the central cover comprising a body having an outer surface;

fins projecting radially outwardly from the rotatable axis and from the outer surface of the cover body, the fins extending between radially inner ends adjacent the rotational,axis and radially outer ends adjacent the inner ends of the fan blades and functioning to disperse air outwardly from the rotational axis along the outer surface of the cover body toward the fan blades to increase the efficiency of the air flow from the fan clutch by removing a dead air bubble at the rotational axis of the fan clutch.

2. A fan clutch in accordance with claim 1 wherein the fins curve from inner ends to outer ends to push air from the center of fan clutch outwardly to the fan blades.

3. A fan clutch in accordance with claim 2 wherein the fins comprise first fins of a curved configuration, and they extend outwardly from a central opening to adjacent and outer rim of the fan hub.

4. A fan clutch in accordance with claim 3 wherein the central cover and the fins are integral and comprise a one-piece, plastic part.

5. A fan clutch in accordance with claim 3 wherein the fins comprise short, additional, curved fins, which are provided between the first fins.

6. A fan clutch in accordance with claim 1 wherein:

electromagnetics are carried by the rotatable driving member; and magnetic elements are carried by the rotatable driven member and are magnetically coupled to transfer torque from the driving member to the driven member.

7. A fan clutch for selectively coupling a source of power:

a fan clutch having a rotatable driving member connected to the source of power to be rotated;

a rotatable, driven member for selective coupling to the driving member to be rotated by the driving member when clutched thereto;

fan blades on the rotatable, driven member to cause air flow to provide cooling and rotatable about a rotational axis;

a central hub driven by the rotatable driven member and located at the rotational axis of the fan clutch;

fins projecting outwardly from the central hub and rotatable axis to disperse air outwardly from the rotational axis of the fan clutch toward the fan blades;

the fins comprise first fins of a curved configuration, and they extend outwardly from a central opening to adjacent and outer rim of the fan hub; and the fins comprise longer fins extending from the central opening outwardly beyond the rim of the fan hub.

8. A fan clutch hub for attachment to a fan clutch having fan blades rotating about a rotational axis comprising:

a one-piece, plastic body having a central hub portion the body being circular in shape and being in the form of a thin disk having its central hub portion for location at the rotational axis of the fan clutch;

the disk-shaped body having an outer rim to be positioned adjacent inner ends of the fan blades on the fan clutch;

the disk-shaped body acting as a cover to cover a central portion of the fan clutch at its rotational axis;

a plurality of integral fins on the plastic body projecting outwardly from the plastic body; and the fins extending outwardly from the rotational axis to adjacent the outer rim of the disk-shaped body to pump air outwardly from the rotational axis to the inner ends of the fan blades of the fan clutch to increase the efficiency of the fan clutch by removing a dead air bubble at the rotational axis of the fan clutch.

9. A plastic fan clutch hub in accordance with claim 8 wherein at least one of said fins projects outwardly beyond the rim of the disk-shaped body.

10. A plastic fan clutch hub in accordance with claim 8 comprising fastener means located at the rotational axis of the disk-shaped body to secure the cover to the fan clutch at the rotational axis of the disk-shaped body.

11. A plastic fan clutch hub in accordance with claim 8 comprising:

a central opening in the disk-shaped body at the location of the rotational axis; and fins on the disk-shaped body having outer ends wrapped about the rim of the disk-shaped body and projecting radially outward beyond the rim.

12. A plastic fan clutch hub in accordance with claim 8 comprising:

a curved outer forward surface on the disk-shaped body curving rearwardly towards the fan clutch from the central hub portion and towards the rim of the disk-shaped body; and curved outer surfaces on the fin curving rearwardly towards the fan clutch from the central hub portion and towards the rim of the disk-shaped body.

* * * * *

UNITED STATES PATENT AND TRADEMARK OFFICE

CERTIFICATE OF CORRECTION

PATENT NO. : 6,468,037 B1
DATED : October 22, 2002
INVENTOR(S) : Larry R. Link

It is certified that error appears in the above-identified patent and that said Letters Patent is hereby corrected as shown below:

Column 6,
Line 39, change “rotational,axis” to -- rotational axis --.

Signed and Sealed this

Fifteenth Day of April, 2003

JAMES E. ROGAN
*Director of the United States Patent and Trademark Office*